US011988412B2

(12) United States Patent
Konowalczyk

(10) Patent No.: US 11,988,412 B2
(45) Date of Patent: May 21, 2024

(54) METHODS AND SYSTEMS FOR MODULATING ENERGY USAGE

(71) Applicant: OCTOPUS ENERGY HEATING LIMITED, London (GB)

(72) Inventor: Peter Konowalczyk, London (GB)

(73) Assignee: Octopus Energy Heating Limited, London (GB)

( * ) Notice: Subject to any disclaimer, the term of this patent is extended or adjusted under 35 U.S.C. 154(b) by 0 days.

(21) Appl. No.: 18/263,185

(22) PCT Filed: Feb. 7, 2022

(86) PCT No.: PCT/IB2022/051070
§ 371 (c)(1),
(2) Date: Jul. 27, 2023

(87) PCT Pub. No.: WO2022/168039
PCT Pub. Date: Aug. 11, 2022

(65) Prior Publication Data

US 2024/0085061 A1 Mar. 14, 2024

(30) Foreign Application Priority Data

Feb. 7, 2021 (GB) ..... 2101678
Jul. 2, 2021 (GB) ..... 2109593
(Continued)

(51) Int. Cl.
*F24H 15/429* (2022.01)
*F24D 19/10* (2006.01)
(Continued)

(52) U.S. Cl.
CPC ..... *F24H 15/429* (2022.01); *F24D 19/1072* (2013.01); *F24H 15/168* (2022.01);
(Continued)

(58) Field of Classification Search
CPC .... F24H 15/429; F24H 15/168; F24H 15/273; F24H 15/277; F24D 19/1072; F24D 2200/08; F24D 2200/12
See application file for complete search history.

(56) References Cited

U.S. PATENT DOCUMENTS 4,798,059 A 1/1989 Morita
2011/0044671 A1* 2/2011 Amiran ..... F24H 15/144 392/441
(Continued)

FOREIGN PATENT DOCUMENTS

AT 504285 A1 4/2008
CN 201191144 Y 2/2009
(Continued)

OTHER PUBLICATIONS

GB Search Report received for GB Serial No. GB2111077.0 on Sep. 24, 2021, 1 pg.
(Continued)

*Primary Examiner* — Kidest Bahta
(74) *Attorney, Agent, or Firm* — Merchant & Gould P.C.

(57) ABSTRACT

The present disclosure relates to modulating energy consumption by a water provision system installed in a building, including one or more electrical heating elements operable to heat water, a heat pump configured to transfer thermal energy from outside the building to a thermal energy storage medium inside the building and a control module configured to control operation of the water provision system, the water provision system being configured to provide water heated by the one or more electrical heating elements and/or the thermal energy storage medium to one or more water outlets, This can include: determining a level of energy demands of a geographical region comprising the building; and upon determining that the level of energy demands is high, controlling the water provision system to switch from using
(Continued)

the one or more electrical heating elements to the thermal energy storage medium for provision of heated water.

15 Claims, 4 Drawing Sheets

(30) Foreign Application Priority Data

| | | |
|---|---|---|
| Jul. 2, 2021 | (GB) | 2109594 |
| Jul. 2, 2021 | (GB) | 2109596 |
| Jul. 2, 2021 | (GB) | 2109597 |
| Jul. 2, 2021 | (GB) | 2109598 |
| Jul. 2, 2021 | (GB) | 2109599 |
| Jul. 2, 2021 | (GB) | 2109600 |
| Aug. 2, 2021 | (GB) | 2111077 |

(51) Int. Cl.
*F24H 15/168* (2022.01)
*F24H 15/273* (2022.01)
*F24H 15/277* (2022.01)

(52) U.S. Cl.
CPC ..... *F24H 15/273* (2022.01); *F24H 15/277* (2022.01); *F24D 2200/08* (2013.01); *F24D 2200/12* (2013.01)

(56) References Cited

U.S. PATENT DOCUMENTS

| | | | | |
|---|---|---|---|---|
| 2011/0081255 | A1* | 4/2011 | Steger | F04D 15/0066 417/44.1 |
| 2011/0271953 | A1 | 11/2011 | Wortmann | |
| 2012/0060771 | A1 | 3/2012 | Brian | |
| 2012/0072040 | A1* | 3/2012 | Kaji | H02J 3/32 700/291 |
| 2012/0152514 | A1* | 6/2012 | Takasaki | F24H 15/238 165/10 |
| 2012/0205456 | A1* | 8/2012 | Honma | F24D 19/106 237/2 B |
| 2012/0232706 | A1 | 9/2012 | Hayashida | |
| 2013/0284818 | A1 | 10/2013 | Hayashida | |
| 2014/0166232 | A1* | 6/2014 | Al-Hallaj | F24T 10/15 165/11.1 |
| 2014/0374497 | A1* | 12/2014 | Nikaido | F25B 1/10 236/1 C |
| 2018/0038616 | A1 | 2/2018 | Scheers | |
| 2021/0318027 | A1 | 10/2021 | Boros | |

FOREIGN PATENT DOCUMENTS

| | | | | |
|---|---|---|---|---|
| CN | 201265954 | Y | 7/2009 | |
| CN | 203758014 | U | 8/2014 | |
| CN | 111189348 | A | 5/2020 | |
| CN | 111750528 | A | 10/2020 | |
| CN | 111811142 | A | 10/2020 | |
| DE | 29921889 | U | 6/2000 | |
| DE | 10006564 | A1 | 8/2000 | |
| DE | 10151253 | C1 | 11/2002 | |
| DE | 102008043030 | A1 | 4/2010 | |
| DE | 102014225693 | A1 | 6/2016 | |
| EP | 0007538 | A1 | 2/1980 | |
| EP | 1684035 | A1 | 12/2007 | |
| EP | 2799784 | A2 | 11/2014 | |
| EP | 2799784 | B1 * | 3/2017 | F24D 19/1072 |
| EP | 3396270 | A1 | 10/2018 | |
| GB | 2609902 | B | 8/2023 | |
| JP | S5795534 | A | 6/1982 | |
| JP | S5812992 | A | 1/1983 | |
| JP | H01256792 | A | 10/1989 | |
| JP | H1144495 | A | 2/1999 | |
| JP | 2012002469 | A | 1/2012 | |
| KR | 20100030141 | A | 3/2010 | |
| WO | 2020209979 | A2 | 10/2020 | |

OTHER PUBLICATIONS

GB Search Report received for GB Serial No. GB2304349.0 on Apr. 25, 2023, 1 pg.
GB Search Report received for GB Serial No. GB2300970.7 on Feb. 20, 2023, 2 pgs.
GB Search Report received for GB Serial No. GB2215387.8 on Jan. 16, 2023, 1 pg.
GB Search Report received for GB Serial No. GB2109600.3 on Aug. 20, 2021, 1 pg.
GB Search Report received for GB Serial No. GB2109599.7 on Aug. 10, 2021, 1 pg.
GB Examination Report received for GB Serial No. GB2109599.7 on Apr. 14, 2023, 2 pgs.
GB Search Report received for GB Serial No. GB2109598.9 on Aug. 10, 2021, 1 pg.
GB Search Report received for GB Serial No. GB2109597.1 on Aug. 10, 2021, 1 pg.
GB Search Report received for GB Serial No. GB2109596.3 on Aug. 10, 2021, 1 pg.
GB Search Report received for GB Serial No. GB2109594.8 on Aug. 12, 2021, 1 pg.
GB Search Report received for GB Serial No. GB2109593.0 on Aug. 20, 2021, 1 pg.
International Search Report and Written Opinion received for PCT Serial No. PCT/IB2022/051070 on May 19, 2022, 13 pgs.

* cited by examiner

METHODS AND SYSTEMS FOR MODULATING ENERGY USAGE

CROSS-REFERENCE TO RELATED APPLICATIONS

The present application is a National Stage Filing of PCT International Application No. PCT/IB2022/051070 filed on Feb. 7, 2022, which claims priority to Great Britain Patent Application No. 2101678.7, filed on Feb. 7, 2021, which claims priority to Great Britain Patent Application No. 2109593.0, filed Jul. 2, 2021, which claims priority to Great Britain Patent Application No. 2109594.8, filed Jul. 2, 2021, which claims priority to Great Britain Patent Application No. 2109596.3, filed Jul. 2, 2021, which claims priority to Great Britain Patent Application No. 2109597.1, filed Jul. 2, 2021, which claims priority to Great Britain Patent Application No. 2109598.9, filed Jul. 2, 2021, which claims priority to Great Britain Patent Application No. 2109599.7, filed Jul. 2, 2021, which claims priority to Great Britain Patent Application No. 2109600.3, filed Jul. 2, 2021, which claims priority to Great Britain Patent Application No. 2111077.0, filed Aug. 2, 2021, all of which are incorporated in their entirety herein by reference.

The present disclosure relates to methods and systems for managing utility consumption. In particular the present disclosure relates to methods and systems for actively modulating water and/or energy consumption in a domestic setting, as well as commercial, public and other settings with water and/or energy provisions.

BACKGROUND

Whether it is in a commercial or domestic setting, heated water is required throughout the day all year round. It goes without saying that the provision of heated water requires both clean water and a source of heat. To provide heated water, a heating system is provided to an often centralised water provision system to heat water up to a predetermined temperature e.g. set by a user, and the heat source used is conventionally one or more electric heating elements or burning of natural gas. Generally, during periods of high energy (e.g. gas or electricity) demand utilities providers would implement a peak tariff which increases the unit cost of energy, partly to cover the additional cost of having to purchase more energy to supply to customers and partly to discourage unnecessary energy usage. Then, during periods of low energy demand utilities providers would implement an off-peak tariff which lowers the unit cost of energy to incentivise customers to switch to using energy during these off-peak periods instead of peak periods to achieve an overall more balanced energy consumption over time. However, such strategies are only effective if customers are always aware of the changes in tariffs and in addition make a conscious effort to modify their energy consumption habits.

Clean water as utility is currently receiving much attention. As clean water becoming scarcer, there has been much effort to educate the public on the conservation of clean water as well as development of systems and devices that reduce water consumption, such as aerated showers and taps to reduce water flow, showers and taps equipped with motion sensors that stop the flow of water when no motion is detected, etc. However, these systems and devices are restricted to a single specific use and only have limited impact on problematic water consumption habits.

With growing concerns over the environmental impact of energy consumption, there has been a recent growing interest in the use of heat pump technologies as a way of providing domestic heated water. A heat pump is a device that transfers thermal energy from a source of heat to a thermal reservoir. Although a heat pump requires electricity to accomplish the work of transferring thermal energy from the heat source to the thermal reservoir, it is generally more efficient than electrical resistance heaters (electrical heating elements) as it typically has a coefficient of performance of at least 3 or 4. This means under equal electricity usage 3 or 4 times the amount of heat can be provided to users via heat pumps compared to electrical resistance heaters.

The heat transfer medium that carries the thermal energy is known as a refrigerant. Thermal energy from the air (e.g. outside air, or air from a hot room in the house) or a ground source (e.g. ground loop or water filled borehole) is extracted by a receiving heat exchanger and transferred to a contained refrigerant. The now higher energy refrigerant is compressed, causing it to raise temperature considerably, where this now hot refrigerant exchanges thermal energy via a heat exchanger to a heating water loop. In the context of heated water provision, heat extracted by the heat pump can be transferred to a water in an insulated tank that acts as a thermal energy storage, and the heated water may be used at a later time when needed. The heated water may be diverted to one or more water outlets, e.g. a tap, a shower, a radiator, as required. However, a heat pump generally requires more time compared to electrical resistance heaters to get water up to the desired temperature.

Since different households, workplaces and commercial spaces have different requirements and preferences for heated water usage, new ways of heated water provision are desirable in order to enable heat pumps to be a practical alternative to electrical heaters. Moreover, in order to conserve energy and water, it may be desirable to modulate the consumption of energy and clean water; however, modulating utility consumption cannot simply be a blanket cap on usage.

It is therefore desirable to provide improved methods and systems for modulating energy consumption.

SUMMARY

In view of the foregoing, an aspect of the present technology provides a computer-implemented method of modulating energy consumption by a water provision system installed in a building, the water provision system comprising one or more electrical heating elements operable to heat water, a heat pump configured to transfer thermal energy from outside the building to a thermal energy storage medium inside the building and a control module configured to control operation of the water provision system, the water provision system being configured to provide water heated by the one or more electrical heating elements and/or the thermal energy storage medium to one or more water outlets, the method being performed by the control module and comprising: determining a level of energy demands of a geographical region comprising the building; and upon determining that the level of energy demands is high, controlling the water provision system to switch from using the one or more electrical heating elements to the thermal energy storage medium for provision of heated water.

Embodiments of the present technology actively switches to a more energy-efficient heat source for provision of heated water during periods of high energy demands. In doing so, it is possible to reduce energy demands during periods of high energy demands.

There may be occasions when the thermal energy storage medium has insufficient energy stored therein for provision of heated water, for example during periods of high demands and/or on colder days. In some embodiments, the method may further comprise operating the heat pump to transfer thermal energy to the thermal energy storage medium based on an expected heated water demand. In doing so, the heat pump is operated in anticipation of an expected heated water demand to ensure that there is a sufficient amount of heat stored in the thermal energy storage medium to meet the expected demand.

Heated water usage often follows a predictable pattern. For example, in a domestic setting, demands for heated water are often high in the morning and in the evening, but low during the middle of the day. In some embodiments, the method may further comprise determining the expected heated water demand based on a water usage pattern established from historic usage of the water provision system. In doing so, the heat pump may be operated to store heat in the thermal energy storage medium ahead of an expected rise in demands.

In some embodiments, the method may further comprise, upon determining that the level of energy demands is high, implementing at least one utility consumption reduction strategy. By implementing one or more utility consumption reduction strategies, the control module is able to control and modulate heated water usage to reduce energy expenditure and/or water consumption during periods of high energy demands.

In some embodiments, the at least one utility consumption reduction strategy may comprise determining that a first water outlet of the one or more water outlets is in-use, and reducing a flow rate of heated water being provided to the first water outlet from a first flow rate to a second flow rate lower than the first flow rate. By reducing the flow rate of heated water, less water is used over a given period of time and as such less energy is required to heat the water.

In some embodiments, the at least one utility consumption reduction strategy may comprise determining that a second water outlet of the one or more water outlets is in-use, and reducing a temperature of heated water being provided to the second water outlet from a first temperature to a second temperature lower than the first temperature. By reducing the temperature of heated water, less energy is required to heat a given amount of water.

In some embodiments, the water provision system may be configured to supply heated water to a central heating system configured to raise an indoor temperature of the building, and the at least one utility consumption reduction strategy may comprise controlling the water provision system to supply heated water to the central heating system such that a heating output of the central heating system meets at least one heating target.

In some embodiments, controlling the water provision system to supply heated water to the central heating system may comprise adjusting a flow rate and/or a temperature and/or a duration of heated water being supplied to the central heating system.

In some embodiments, the at least one heating target may comprise a maximum amount of energy to be used for heating water supplied to the central heating system.

In some embodiments, the maximum amount of energy may be determined based on an amount of energy stored in the thermal energy storage medium.

In some embodiments, the method may further comprise operating the heat pump to store thermal energy in the thermal energy storage medium upon determining that the level of energy demands is low. In doing so, it is possible to ensure that the thermal energy storage medium is ready for heated water provision when the water provision system is controlled to switch from using the one or more electrical heating elements to the thermal energy storage medium for provision of heated water during periods of high energy demands.

In some embodiments, the level of energy demands may be determined based on tariff data obtained from an energy supplier.

In some embodiments, the level of energy demands may be determined to be high when the tariff data indicates a peak tariff.

Another aspect of the present technology provides a control module configured to control operation of a water provision system installed in a building, the water provision system comprising a heat pump configured to transfer thermal energy to a thermal energy storage medium and one or more electrical heating elements operable to heat water, the water provision system being configured to provide water heated by the one or more electrical heating elements operable to heat water and/or the thermal energy storage medium to one or more water outlets, the control module comprising control circuitry configured to: determine a level of energy demands of a geographical region comprising the building; and upon determining that the level of energy demands is high, control the water provision system to switch from using the one or more electrical heating elements to the thermal energy storage medium for provision of heated water.

A further aspect of the present technology provides a water provision system for provisioning water to one or more water outlets disposed within a building, comprising: one or more electrical heating elements configured to heat water for provision by the water provision system; a thermal energy storage disposed inside the building configured to store thermal energy; a heat exchanger arranged proximal to the thermal energy storage configured to heat water for provision by the water provision system using thermal energy stored in the thermal energy storage; a heat pump configured to transfer thermal energy from outside the building to the thermal energy storage; and a control module configured to control operation of the water provision system, the control module comprising control circuitry configured to: determine a level of energy demands of a geographical region comprising the building; and upon determining that the level of energy demands is high, control the water provision system to switch from using the one or more electrical heating elements to the thermal energy storage medium for provision of heated water.

The present technology further provides a computer program stored on a computer readable storage medium for, when executed on a computer system, instructing the computer system to carry out the method as described above.

Implementations of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

Embodiments of the present disclosure will now be described with reference to the accompanying drawings, in which.

DETAILED DESCRIPTION

In view of the foregoing, the present disclosure provides various approaches for the provision of heated water using or assisted by a heat pump, and in some cases for modulating the use of utilities including water and energy to reduce water and energy wastage.

Water Provision System

Figure 1:
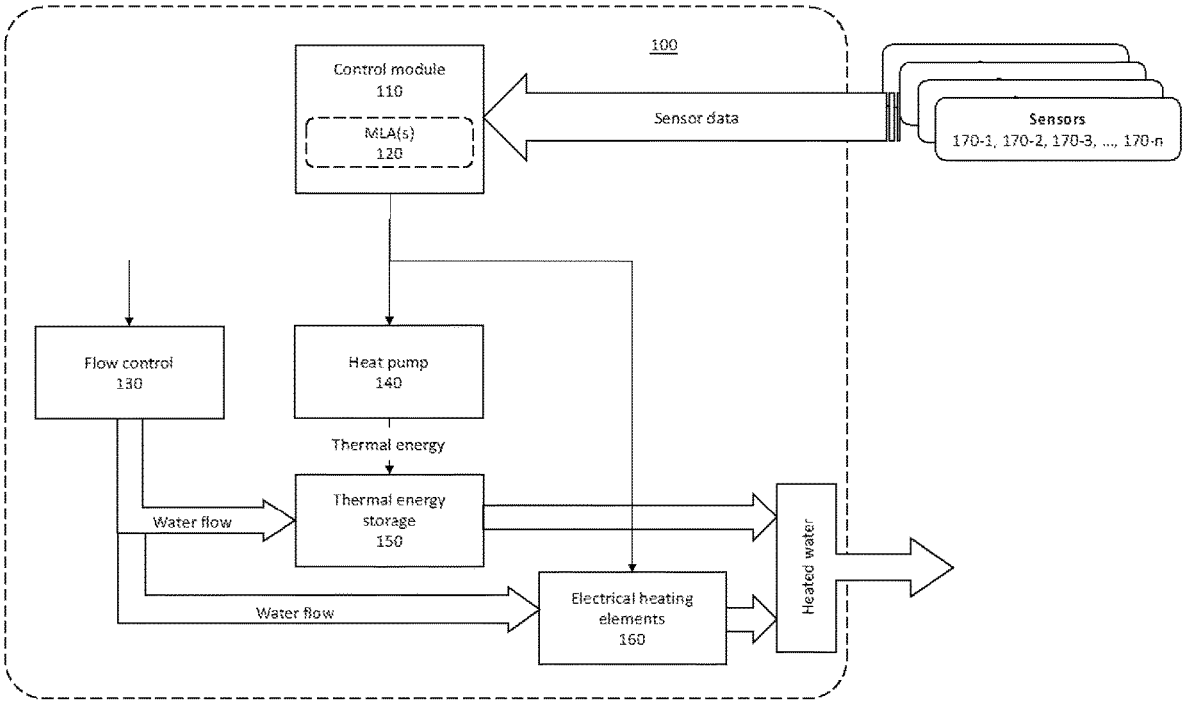
FIG. 1 is a schematic system overview of an exemplary water provision system.

In embodiments of the present techniques, cold and heated water is provisioned by a centralized water provision system to a plurality of water outlets, including taps, showers, radiators, etc., for a building in a domestic or commercial setting. An exemplary water provision system 100 is shown in FIG. 1.

In the present embodiment, the water provision system 100 comprises a control module 110. The control module 110 is communicatively coupled to, and configured to control, various elements of the water provision system, including flow control 130 for example in the form of one or more valves arranged to control the flow of water internal and external to the system, a (ground source or air source) heat pump 140 configured to extract heat from the surrounding and deposit the extracted heat in a thermal energy storage 150 to be used to heat water, and one or more electric heating elements 160 configured to directly heat cold water to a desired temperature by controlling the amount of energy supplied to the electric heating elements 160. Heated water, whether heated by the thermal energy storage 150 or heated by the electric heating elements 160, is then directed to one or more water outlets and or a central heating system as and when needed. In the embodiments, the heat pump 140 extracts heat from the surrounding into a thermal energy storage medium within the thermal energy storage 150 until the thermal energy storage medium reach an operation temperature, then cold water e.g. from the mains can be heated by the thermal energy storage medium to the desired temperature. The heated water may then be supplied to various water outlets in the system.

In the present embodiment, the control module 110 is configured to receive input from a plurality of sensors 170-1, 170-2, 170-3, . . . , **170-*n*. The plurality of sensors 170-1, 170-2, 170-3, . . . , 170-*n* may for example include one or more air temperature sensors disposed indoor and/or outdoor, one or more water temperature sensors, one or more water pressure sensors, one or more timers, one or more motion sensors, and may include other sensors not directly linked to the water provision system 100 such as a GPS signal receiver, calendar, weather forecasting app on e.g. a smartphone carried by an occupant and in communication with the control module via a communication channel. The control module 110 is configured, in the present embodiment, to use the received input to perform a variety of control functions, for example controlling the flow of water through the flow control 130 to the thermal energy storage 150 or electric heating elements 160** to heat water.

Optionally, one or more machine learning algorithm (MLA) 120 may execute on the control module 110, for example on a processor (not shown) of the control module 110 or on a server remote from the control module 110 and communicates with the processor of the control module 110 over a communication channel. For example, the MLA 120 may be trained using the input sensor data received by the control module 110 to establish a baseline water and energy usage pattern based e.g. on the time of the day, the day of the week, the date (e.g. seasonal changes, public holiday), occupancy, etc. The learned usage pattern may then be used to determine, and in some cases improve, the various control functions performed by the control module 110, and/or generate a report e.g. to enable a user to analyze their utility usage and/or provide suggestions for more efficient utility usage.

While a heat pump is generally more energy efficient for heating water compared to an electrical resistance heater, a heat pump requires time to transfer a sufficient amount of thermal energy into a thermal energy storage medium for it to reach a desired operating temperature before heat from the thermal energy storage medium can be used to heat water; thus, a heat pump generally takes longer to heat the same amount of water to the same temperature compared to an electrical resistance heater. In some embodiments, the heat pump 140 may for example use a phase change material (PCM), which changes from a solid to a liquid upon heating, as a thermal energy storage medium. In this case, additional time may be required to turn the PCM from solid to liquid, if it has been allowed to solidify, before thermal energy extracted by the heat pump can be used to raise the temperature of the thermal storage medium. Although this approach of heating water may be slower, the overall amount of energy consumed for heating water is less compared to heating water with electric heating elements, so overall, energy is conserved and the cost for heated water provision is reduced.

Phase Change Materials

In the present embodiments, a phase change material may be used as a thermal storage medium for the heat pump. One suitable class of phase change materials are paraffin waxes which have a solid-liquid phase change at temperatures of interest for domestic hot water supplies and for use in combination with heat pumps. Of particular interest are paraffin waxes that melt at temperatures in the range 40 to 60 degrees Celsius (° C.), and within this range waxes can be found that melt at different temperatures to suit specific applications. Typical latent heat capacity is between about 180 kJ/kg and 230 kJ/kg and a specific heat capacity of perhaps 2.27 $Jg^{-1}K^{-1}$ in the liquid phase, and 2.1 $Jg^{-1}K^{-1}$ in the solid phase. It can be seen that very considerable amounts of energy can be stored taking using the latent heat of fusion. More energy can also be stored by heating the phase change liquid above its melting point. For example, when electricity costs are relatively low during off-peak periods, the heat pump may be operated to "charge" the thermal energy storage to a higher-than-normal temperature to "overheat" the thermal energy storage.

A suitable choice of wax may be one with a melting point at around 48° C., such as n-tricosane $C_{23}$, or paraffin $C_{20}$-$C_{33}$, which requires the heat pump to operate at a temperature of around 51° C., and is capable of heating water to a satisfactory temperature of around 45° C. for general domestic hot water, sufficient for e.g. kitchen/bathroom taps, shower, etc. Cold water may be added to a flow to reduce water temperature if desired. Consideration is given to the temperature performance of the heat pump. Generally, the maximum difference between the input and output temperature of the fluid heated by the heat pump is preferably kept in the range of 5° C. to 7° C., although it can be as high as 10° C.

While paraffin waxes are a preferred material for use as the thermal energy storage medium, other suitable materials may also be used. For example, salt hydrates are also suitable for latent heat energy storage systems such as the present ones. Salt hydrates in this context are mixtures of inorganic salts and water, with the phase change involving the loss of all or much of their water. At the phase transition, the hydrate crystals are divided into anhydrous (or less aqueous) salt and water. Advantages of salt hydrates are that they have much higher thermal conductivities than paraffin waxes (between 2 to 5 times higher), and a much smaller volume change with phase transition. A suitable salt hydrate for the current application is $Na_2S_2O_3 \cdot SH_2O$, which has a melting point around 48° C. to 49° C., and latent heat of 200-220 kJ/kg.

Utility Modulation

Since energy and clean water are essential commodities, it is desirable to modulate their use. The present approach provides methods and systems to actively modulate energy usage that are integrated into a heated water provision system suitable for home, commercial or public use. The present approach is of particularly relevance where a heat pump is used for the provision of heated water. Actively modulating energy consumption based on current energy demands enables a heat pump to be operated to store heat in a thermal energy storage when energy demands on the national grid are low (e.g. during off-peak hours), and the stored energy can be later extracted to provide heated water and/or central heating when energy demands are high (e.g. during peak hours). This then reduces energy demands during peak periods to allow an improved balance of energy demands between peak and off-peak periods and improve the usability of heat pumps as a form of heated water provision and central heating.

Figure 2:
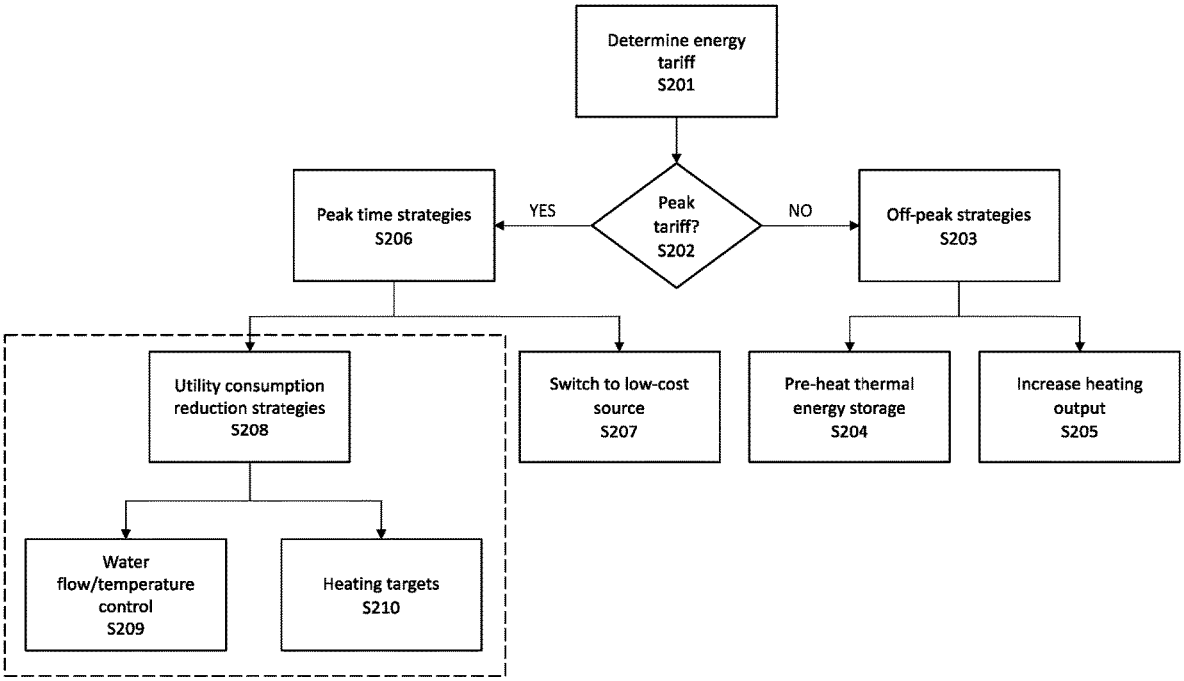
FIG. 2 shows an exemplary method of modulating utility usage based on tariff.

FIG. 2 shows a method for modulating energy consumption based on current energy tariff according to an embodiment. Energy tariffs, e.g. obtain from an energy supplier, reflect the national or regional energy demands in a given time period; thus, in the present embodiment, energy tariffs are used as an indicator for implementing energy modulation.

The method may be implemented through a control module (e.g. control module 110) of a water provision system (e.g. water provision system 100) that provides heated water e.g. for a household in a domestic setting.

The method begins at S201 when the control module determines the current energy tariff, e.g. using data directly received from the energy supplier and/or based on data obtained from public domain (e.g. from the energy supplier's website).

At S202, the control module determines if the current energy tariff is a peak tariff (the unit cost of energy is high) that indicates a high demand on energy, or an off-peak tariff (the unit cost of energy is low) that indicates a low demand on energy. If the control module at S202 determines that the current energy tariff is an off-peak tariff, then at S203, the control module performs one or more off-peak strategies. For example, at S204, a heat pump (e.g. heat pump 140) may be operated to store energy in a thermal energy storage (e.g. thermal energy storage 150) such that at a later time, e.g. during peak periods, the stored energy can be extracted to heat water. For example, at S205, the control module may increase the amount and/or temperature of heated water provided by the water provision system to a central heating system in order to increase heating output of the central heating system, and use the building structure in which the water provision system is installed as a heat storage medium. These examples will be discussed in more details below and are non-exhaustive; other strategies may be implemented in addition or as alternatives.

If the control module at S202 determines that the current energy tariff is a peak tariff, the control module can instruct the water provision system to actively switch to a low-cost energy source for heating water, e.g. using thermal energy already stored in the thermal energy storage and/or operating the heat pump to continue transferring heat to the thermal energy storage in favour of operating the electrical heating elements.

In addition, or alternatively, the control module can implement one or more utility consumption reduction strategies to modulate utility consumption at S208. The control module may be programmed with one or more different reduction strategies and select one or more such strategies to implement during peak periods. A non-exhaustive list of example strategies is given here. At S209, the control module can modulate the flow rate (or pressure) and/or temperature of heated water provided by the water provision system to a water outlet based on a heated water budget. For example, the flow rate of heated water to a water outlet may be reduced compared to the level set by a user in order to remain within the heated water budget, and/or the temperature of heated water supplied to a water outlet may be decreased compared to the temperature set by a user in order to remain within the heated water budget. At S210, the control module can adjust the amount (flow rate, pressure) and/or temperature of heated water provisioned to the central heating system, for example according to one or more heating targets. For example, the control module can instruct the water provision system to reduce the amount and/or temperature of heated water supplied to the central heating system to meet an energy output target. These strategies will be discussed in more detail below.

Off-Peak Strategies

During off-peak periods, the control module can implement one or more off-peak strategies S203 to optimise the periods of low energy demands.

In an embodiment, the control module is configured to operate the heat pump 140 to store energy in the thermal energy storage 150 during off-peak periods (S204), when energy demands are low. The stored energy can be extracted at a later time, e.g. during peak periods, by the water provision system to heat water for provision to one or more water outlets and/or the central heating system. The heat pump 140 may be operated to transfer heat from the surrounding into the thermal energy storage 150 to raise the temperature of, or charge, the thermal energy storage 150 to a predetermined operating temperature (e.g. 48° C.). Alternatively, the heat pump 140 may be operated to charge the thermal energy storage 150 to a temperature higher that the predetermined operating temperature to "overheat" the thermal energy storage 150 such that more energy is stored in the thermal energy storage 150 that can be used during peak periods. In this case, water will be heated by the thermal energy storage 150 to a temperature higher than if the thermal energy storage 150 is charged to the lower predetermined operating temperature; however, the water temperature can be easily adjusted to a desired temperature by adding cold water and adjusting the proportions of cold water and heated water.

In an embodiment, during off-peak periods, the control module is configured to increase the amount and/or temperature of heated water provided by the water provision system to the central heating system in order to increase the heating output of the central heating system (S205). More specifically, during off-peak periods when energy demands are low and the cost of energy is low, the control module can operate the heat pump 140 to pre-heat the thermal energy storage 150 to the predetermined operating temperature, and control the water provision system to heat water using energy stored in the thermal energy storage 150 and divert the heated water to the central heating system so as to heat the building structure in which the water provision system is installed. In addition, or alternatively, the control module can operate the electrical heating elements 160 to heat water that is then diverted by the water provision system to the central heating system. In addition, or alternatively, the control module can operate one or more electrical space heating devices (e.g. electrical radiators, infrared heaters, fan heaters, etc.) connected thereto to heat the building structure. Thus, in the present approach, the building structure itself is used as a thermal energy buffer in addition to, or as an alternative to, the thermal energy storage 150. The amount of thermal energy that can be stored in the building structure, and the rate at which the building structure loses heat to the surround depends on the heat capacity of the structure, the outdoor temperature, and how well the building is insulated, etc. The control module can then control the water provision system to cease supplying heated water to the central heating system during peak periods and allow the building structure to slowly release the stored thermal energy as a form of passive heating. In addition, or alternatively, an indoor heat pump may be provided to the water provision system and controlled by the control module 110 to extract heat from within the building and transfer the heat to e.g. the thermal energy storage 150. Then, the control module may operate the indoor heat pump to extract the excess thermal energy stored in the building structure and transfer the extracted energy to the thermal energy storage 150 to be used for heating water. Accordingly, the indoor heat pump is used to use the heated building as a thermal storage.

Peak-Time Strategies

As shown in FIG. 2, during peak periods, the control module can implement one or more peak time strategies, S206, to reduce energy demands placed on the national grid and reduce energy cost for the user. One such strategies include switching to a low-cost, i.e. low energy demand, energy source, S207. In an embodiment involving the water provision system 100, which comprises electrical heating elements 160 and heat pump 140 (thermal energy storage 150), the control module 110 is configured to implement this strategy by switching to use the heat pump 140 in favour of the electrical heating elements 160 for heating water.

Optionally, the control module 110 may operate the heat pump 140 during off-peak periods (or low energy demands periods) to charge the thermal energy storage 150 to a predetermined operating temperature or higher. The stored energy may then be used during peak periods (or high energy demands periods) for heating water.

Optionally, the control module 110 may be configured to learn a water usage pattern of users of the water provision system, e.g. by means of MLA 120, which enables the control module to predict when heated water may be needed. In this case, irrespective of whether the thermal energy storage 150 is pre-charged during off-peak periods, the control module can still implement the present peak time strategy by, using the predictions enabled by the water usage pattern, operating the heat pump 140 before predicted heated water demands to prepare the thermal energy storage 150 for provision of heated water, instead of relying on the higher-cost electrical heating elements.

In addition to switching to a low-cost energy source, the control module may optionally be programmed to implement one or more utility consumption reduction strategies during peak tariff S208. The utility consumption reduction strategies may for example include modulation of heated water flow rate and/or temperature supplied by the water provision system S209, and/or modulation of heated water supplied to central heating by the water provision system based on one or more heating targets S210 (for example, based on temperature or duration (time)).

Figure 3:
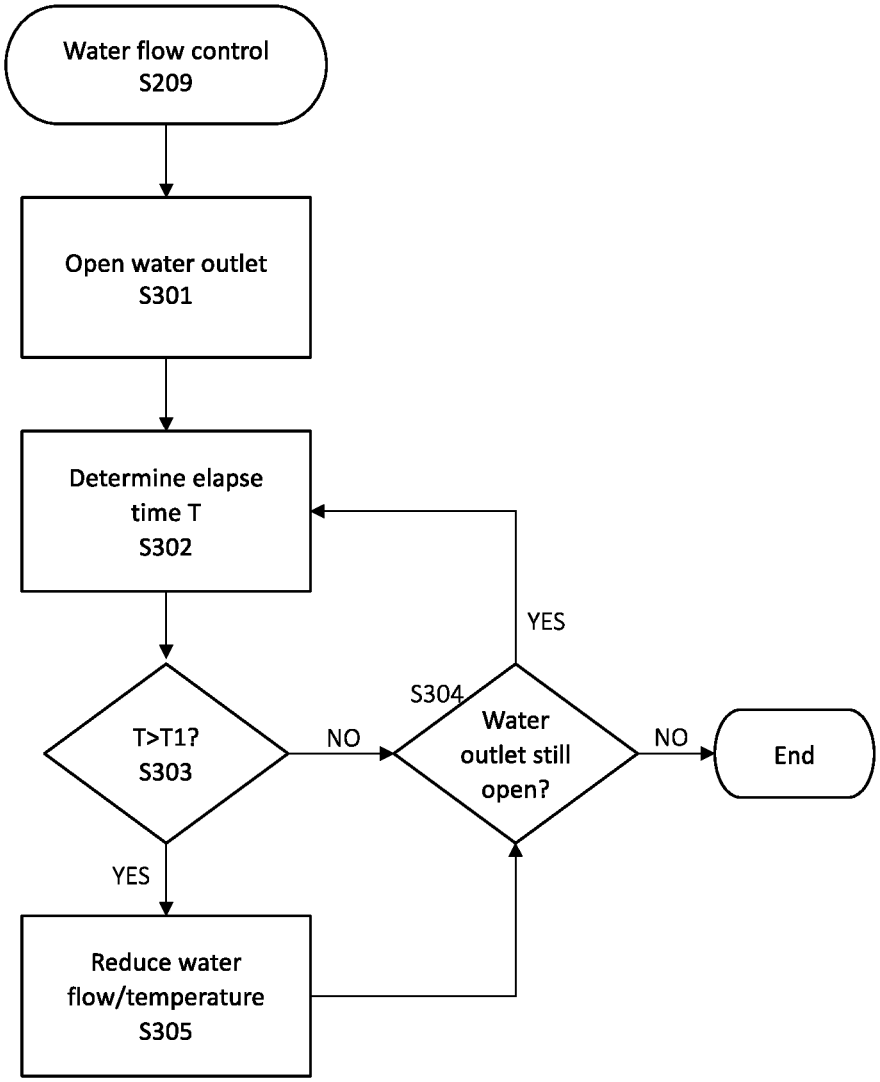
FIG. 3 shows an exemplary method of modulating water flow and temperature.

FIG. 3 shows a method of modulating the flow rate and/or temperature of heated water based on a heated water budget according to an embodiment. At S209, the method begins with the control module implementing a water flow control strategy.

At S301, a water outlet connected to and supplied by the water provision system is opened. The water outlet may for example be a water tap or a shower. The water outlet may be turned on by a user by setting a water temperature e.g. with a temperature control and a flow rate e.g. with a water pressure control.

Upon detecting that the water outlet is turned on, the control module begins monitoring an elapse time T at S302. For example, the control module may be provided with or connected to a timer for recording the elapse time T from when the water outlet is turned on. The control module may be provided with or connected to multiple timers to enable it to determine multiple elapse times when multiple water outlets are turned on at the same time. The elapse time T, together with the water temperature and pressure (flow rate) provides an indication of the amount of energy used.

According to the present embodiment, an elapse time threshold T1 may be set based on a predetermined heated water budget that sets a limit on the amount of heated water, or the amount of energy used for heating water, to be used when the utility consumption reduction strategies are implemented (e.g. during peak hours). Thus, at S303, the control module determines if the elapse time T exceeds the threshold T1. If the control module determines that the elapse time T does not exceed the threshold T1, the control module continues to monitor the water outlet at S304. If the water outlet is still open, the control module continues to monitor the elapse time T. If the water outlet is no longer open, the control module stops monitoring the water outlet and the process ends.

If, at S303, the control module determines that the elapse time T exceeds the threshold T1, the control module at S305 controls the water provision system to reduce the flow rate of the heated water being supplied to the water outlet. In doing so, it is possible to reduce the overall amount of heated water used and thereby reducing both the amount of clean water consumed and the amount of energy required for heating water. the control module may alternatively or additionally control, at S305, the water provision system to reduce the temperature of the heated water being supplied to the water outlet. In doing so, it is possible to reduce the overall amount of energy consumed for heating water.

Optionally, the control module continues to monitor the elapse time T since the water outlet is turned on, and may reduce the flow rate further e.g. if the elapse time T exceeds the threshold T1 again.

Figure 4:
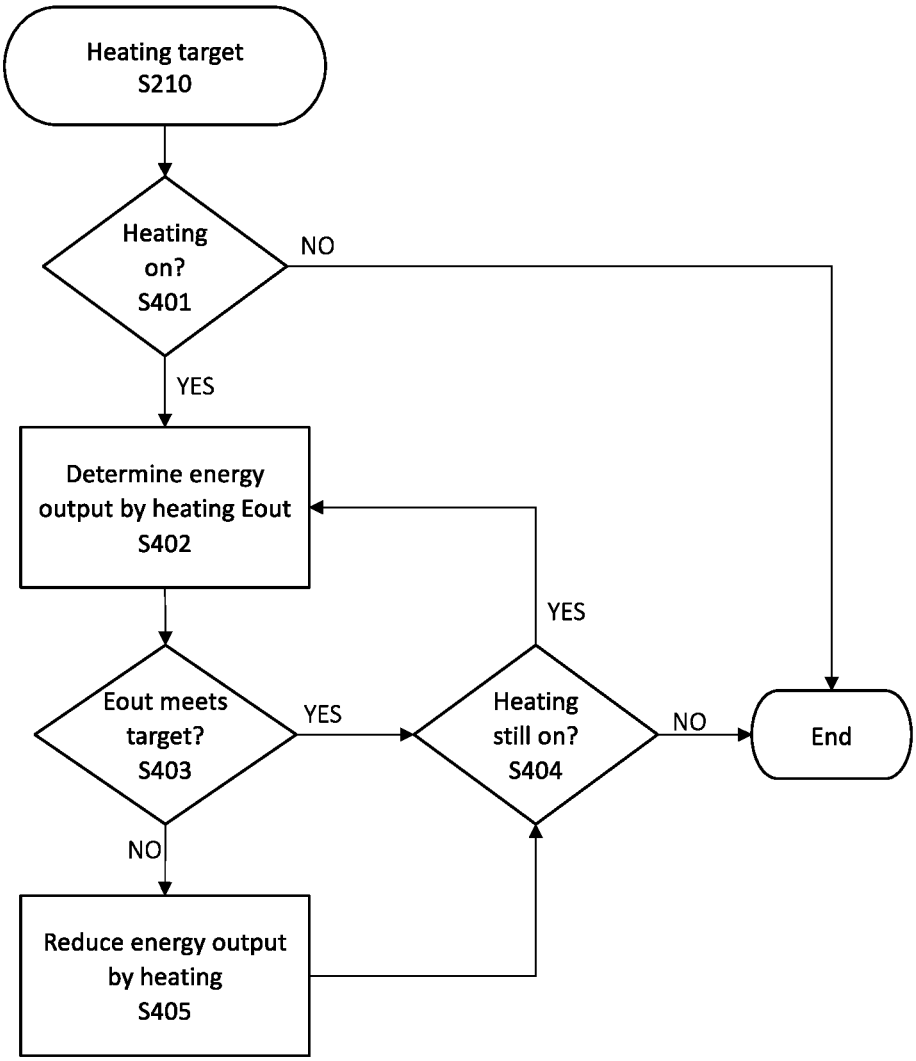
FIG. 4 shows an exemplary method of modulating heating output.

FIG. 4 shows a method for modulating heated water supplied for central heating based on a predetermined heating target of set of heating targets according to an embodiment. At S210, the method begins with the control module implementing a heating target.

At S401, the control module determines whether the central heating system is turned on. For example, the central heating system may be set to turn on at a specified time of the day, and/or when the indoor temperature reaches a specified temperature or below, and/or manually turned on by a user. If it is determined that the central heating system is not turned on, the process ends.

If at S401 it is determined that the central heating system is turned on, the control module proceeds to monitor the energy output $E_{out}$ of the central heating system, for example by monitoring the temperature and amount of heated water diverted to the central heating system and/or monitoring changes in the indoor temperature.

At S402, the control module determines the energy output $E_{out}$ of the central heating system, then at S403, the control module determines if the energy output $E_{out}$ meets a predetermined heating target. The heating target may, for example, sets a predetermined maximum energy output for the central heating system e.g. in terms of an amount of energy to be expended and/or in terms of a maximum cost of energy to be spend on heating water supplied to the central heating system.

If at S403, the control module determines that the energy output $E_{out}$ of the central heating system meets the heating target, e.g. that $E_{out}$ is below the predetermined maximum energy output, the control module continues to monitor at S404 whether the central heating system is still turned on, and continues to monitor the energy output $E_{out}$ of the central heating system if the central heating system is still turned on; otherwise, the process ends.

If at S403, the control module determines that the energy output $E_{out}$ of the central heating system does not meet the heating target, e.g. that $E_{out}$ is above the predetermined maximum energy output, the control module reduces the energy output of the central heating system at S405 e.g. by reducing the temperature of the heated water and/or the amount of heated water (e.g. by reducing the flow and/or by supplying heated water intermittently) supplied to the central heating system by the water provision system. Then, the control module continues to monitor the energy output of the central heating system and may optionally perform further adjustment if the heating target is not met.

By implementing one or more utility consumption reduction strategies, the control module is able to control and modulate heated water usage to keep energy expenditure (optionally water consumption) to a budget. It would be clear to a skilled person that the above-described strategies can be implemented independently or in any combinations as desired.

According to the present approach, by implementing strategies to store thermal energy in one or more thermal energy storage (including the building itself) during periods of low energy demands and using the stored thermal energy to heat water during periods of high energy demands, it is possible to improve the efficiency and usability of a heat pump as a practical low-cost way of provisioning heated water. Moreover, by shifting at least some of the energy demands for heating water from peak periods to off-peak periods, it is possible improve the balance of energy demands during different periods of time.

As will be appreciated by one skilled in the art, the present techniques may be embodied as a system, method or computer program product. Accordingly, the present techniques may take the form of an entirely hardware embodiment, an entirely software embodiment, or an embodiment combining software and hardware.

Furthermore, the present techniques may take the form of a computer program product embodied in a computer readable medium having computer readable program code embodied thereon. The computer readable medium may be a computer readable signal medium or a computer readable storage medium. A computer readable medium may be, for example, but is not limited to, an electronic, magnetic, optical, electromagnetic, infrared, or semiconductor system, apparatus, or device, or any suitable combination of the foregoing.

Computer program code for carrying out operations of the present techniques may be written in any combination of one or more programming languages, including object-oriented programming languages and conventional procedural programming languages.

For example, program code for carrying out operations of the present techniques may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog™ or VHDL (Very high-speed integrated circuit Hardware Description Language).

The program code may execute entirely on the user's computer, partly on the user's computer and partly on a remote computer or entirely on the remote computer or server. In the latter scenario, the remote computer may be connected to the user's computer through any type of network. Code components may be embodied as procedures, methods or the like, and may comprise sub-components which may take the form of instructions or sequences of instructions at any of the levels of abstraction, from the direct machine instructions of a native instruction set to high-level compiled or interpreted language constructs.

It will also be clear to one of skill in the art that all or part of a logical method according to the preferred embodiments of the present techniques may suitably be embodied in a logic apparatus comprising logic elements to perform the steps of the method, and that such logic elements may comprise components such as logic gates in, for example a programmable logic array or application-specific integrated circuit. Such a logic arrangement may further be embodied in enabling elements for temporarily or permanently establishing logic structures in such an array or circuit using, for example, a virtual hardware descriptor language, which may be stored and transmitted using fixed or transmittable carrier media.

The examples and conditional language recited herein are intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its scope as defined by the appended claims.

Furthermore, as an aid to understanding, the above description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to limit the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

Moreover, all statements herein reciting principles, aspects, and implementations of the technology, as well as specific examples thereof, are intended to encompass both structural and functional equivalents thereof, whether they are currently known or developed in the future. Thus, for example, it will be appreciated by those skilled in the art that any block diagrams herein represent conceptual views of illustrative circuitry embodying the principles of the present technology. Similarly, it will be appreciated that any flowcharts, flow diagrams, state transition diagrams, pseudocode, and the like represent various processes which may be substantially represented in computer-readable media and so executed by a computer or processor, whether or not such computer or processor is explicitly shown.

The functions of the various elements shown in the figures, including any functional block labeled as a "processor", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

Software modules, or simply modules which are implied to be software, may be represented herein as any combination of flowchart elements or other elements indicating performance of process steps and/or textual description. Such modules may be executed by hardware that is expressly or implicitly shown.

It will be clear to one skilled in the art that many improvements and modifications can be made to the foregoing exemplary embodiments without departing from the scope of the present techniques.

The invention claimed is:

1. A computer-implemented method of modulating energy consumption by a water provision system installed in a building, the water provision system comprising one or more electrical heating elements operable to heat water, a heat pump configured to transfer thermal energy from outside the building to a thermal energy storage medium within a thermal energy storage inside the building, a heat exchanger arranged proximal to the thermal energy storage configured to heat water for provision by the water provision system using thermal energy stored in the thermal energy storage medium, and a control module executing instructions stored on a non-transitory computer readable medium which causes the control module to control operation of the water provision system, the water provision system being configured to provide water heated by the one or more electrical heating elements and/or the thermal energy storage medium to one or more water outlets, the method being performed by the control module and comprising:

determining a level of energy demands of a geographical region comprising the building; and upon determining that the level of energy demands is high, controlling the water provision system to switch from using the one or more electrical heating elements to the thermal energy storage medium to heat water for provision of heated water.

2. The method of claim 1, further comprising operating the heat pump to transfer thermal energy to the thermal energy storage medium based on an expected heated water demand.

3. The method of claim 2, further comprising determining the expected heated water demand based on a water usage pattern established from historic usage of the water provision system.

4. The method of claim 1, further comprising, upon determining that the level of energy demands is high, implementing at least one utility consumption reduction strategy.

5. The method of claim 4, wherein the at least one utility consumption reduction strategy comprises determining that a first water outlet of the one or more water outlets is in-use, and reducing a flow rate of heated water being provided to the first water outlet from a first flow rate to a second flow rate lower than the first flow rate.

6. The method of claim 4, wherein the at least one utility consumption reduction strategy comprises determining that a second water outlet of the one or more water outlets is in-use, and reducing a temperature of heated water being provided to the second water outlet from a first temperature to a second temperature lower than the first temperature.

7. The method of claim 4, wherein the water provision system is configured to supply heated water to a central heating system configured to raise an indoor temperature of the building, wherein the at least one utility consumption reduction strategy comprises controlling the water provision system to supply heated water to the central heating system such that a heating output of the central heating system meets at least one heating target.

8. The method of claim 7, wherein controlling the water provision system to supply heated water to the central heating system comprises adjusting a flow rate and/or a temperature and/or a duration of heated water being supplied to the central heating system.

9. The method of claim 7, wherein the at least one heating target comprises a maximum amount of energy to be used for heating water supplied to the central heating system.

10. The method of claim 9, wherein the maximum amount of energy is determined based on an amount of energy stored in the thermal energy storage medium.

11. The method of claim 1, further comprising operating the heat pump to store thermal energy in the thermal energy storage medium upon determining that the level of energy demands is low.

12. The method of claim 1, wherein the level of energy demands is determined based on tariff data obtained from an energy supplier.

13. The method of claim 12, wherein the level of energy demands is determined to be high when the tariff data indicates a peak tariff.

14. A control module configured to control operation of a water provision system installed in a building, the water provision system comprising a heat pump configured to transfer thermal energy to a thermal energy storage medium within a thermal energy storage, a heat exchanger arranged proximal to the thermal energy storage configured to heat water for provision by the water provision system using thermal energy stored in the thermal energy storage medium, and one or more electrical heating elements operable to heat water, the water provision system being configured to provide water heated by the one or more electrical heating elements operable to heat water and/or the thermal energy storage medium to one or more water outlets, the control module comprising control circuitry configured to determine a level of energy demands of a geographical region comprising the building, and, upon determining that the level of energy demands is high, control the water provision system to switch from using the one or more electrical heating elements to the thermal energy storage medium to heat water for provision of heated water.

15. A water provision system for provisioning water to one or more water outlets disposed within a building, comprising:

one or more electrical heating elements configured to heat water for provision by the water provision system;

a thermal energy storage disposed inside the building configured to store thermal energy in a thermal storage medium;

a heat exchanger arranged proximal to the thermal energy storage configured to heat water for provision by the water provision system using thermal energy stored in the thermal energy storage;

a heat pump configured to transfer thermal energy from outside the building to the thermal energy storage medium; and a control module configured to control operation of the water provision system, the control module comprising control circuitry configured to determine a level of energy demands of a geographical region comprising the building, and, upon determining that the level of energy demands is high, control the water provision system to switch from using the one or more electrical heating elements to the thermal energy storage medium to heat water for provision of heated water.

* * * * *